US008752530B2

(12) United States Patent
Pearce et al.

(10) Patent No.: US 8,752,530 B2
(45) Date of Patent: Jun. 17, 2014

(54) HYDROCARBON STORAGE CANISTER

(75) Inventors: Russell Randall Pearce, Ann Arbor, MI (US); Mark Edward Hipp, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 511 days.

(21) Appl. No.: 13/209,750

(22) Filed: Aug. 15, 2011

(65) Prior Publication Data

US 2013/0042838 A1 Feb. 21, 2013

(51) Int. Cl.
*F02M 33/02* (2006.01)
*B01D 53/02* (2006.01)

(52) U.S. Cl.
USPC ..... 123/519; 96/135; 96/136; 96/137; 96/138; 96/261

(58) Field of Classification Search
CPC ... F02M 37/00; F02M 37/0041; F02M 25/08; F02M 25/0854; B01D 15/03504; B01D 15/03519; B01D 53/04; B01D 53/0407; B01D 2253/10; B01D 2253/102; B01D 53/26; B01D 53/261; B01D 53/263; A62B 19/00
USPC ..... 96/135–138, 149–151, 261; 123/516, 123/518–520; 137/202
See application file for complete search history.

(56) References Cited

U.S. PATENT DOCUMENTS 4,379,470 A * 4/1983 Reutter ..... 137/493.8
4,520,839 A * 6/1985 Roff ..... 137/202
4,694,810 A * 9/1987 Miyamoto ..... 123/516
4,714,172 A * 12/1987 Morris ..... 220/86.2
4,758,255 A * 7/1988 Yamada et al. ..... 96/137
4,821,908 A * 4/1989 Yost ..... 220/86.2
4,836,172 A * 6/1989 Haruta et al. ..... 123/520
4,877,001 A * 10/1989 Kenealy et al. ..... 123/519
5,259,412 A * 11/1993 Scott et al. ..... 137/588
RE34,518 E * 1/1994 Covert et al. ..... 137/588
5,718,209 A * 2/1998 Scardino et al. ..... 123/519
5,840,104 A * 11/1998 Hashimoto et al. ..... 96/135
5,860,458 A * 1/1999 Benjey et al. ..... 141/59
6,016,827 A * 1/2000 Dawson ..... 137/202
6,062,276 A * 5/2000 Benjey et al. ..... 141/198
6,206,057 B1 * 3/2001 Benjey et al. ..... 141/198
6,237,574 B1 5/2001 Jamrog et al.
6,321,726 B1 11/2001 Khami et al.

(Continued)

FOREIGN PATENT DOCUMENTS

GB 2349177 A 10/2000

OTHER PUBLICATIONS

Austrian Patent Office, Search Report of TR2012/09302, May 17, 2013, Vienna, 7 pages.

*Primary Examiner* — Hieu T Vo
*Assistant Examiner* — Sherman Manley
(74) *Attorney, Agent, or Firm* — James Dottavio; Alleman Hall McCoy Russell & Tuttle LLP

(57) ABSTRACT

A system for a vehicle is provided herein. The system includes a fuel vapor canister comprising a shell, a compression plate within the shell and an end cap. The end cap includes a double sided spring interface and a double sided shell sealing surface having double sided identical grooves, only one of which is sealed to the shell. The system further includes a spring coupled to the compression plate and only one spring interface.

24 Claims, 5 Drawing Sheets

(56) References Cited

U.S. PATENT DOCUMENTS

| | | | | |
|---|---|---|---|---|
| 6,708,713 | B1 * | 3/2004 | Gericke | 137/43 |
| 6,737,766 | B1 | 5/2004 | Burrola et al. | |
| 6,986,357 | B2 * | 1/2006 | Veinotte et al. | 137/12 |
| 7,228,850 | B2 | 6/2007 | King | |
| 7,270,310 | B2 * | 9/2007 | Takakura | 251/30.04 |
| 7,323,041 | B2 * | 1/2008 | Yoshida et al. | 96/132 |
| 7,428,914 | B2 * | 9/2008 | Kaneko et al. | 137/512.1 |
| 7,451,746 | B2 | 11/2008 | Bellmore | |
| 7,472,694 | B2 * | 1/2009 | King | 123/518 |
| 7,476,269 | B2 * | 1/2009 | Begley et al. | 96/147 |
| 7,527,044 | B2 * | 5/2009 | Dunkle et al. | 123/519 |
| 7,654,403 | B2 * | 2/2010 | DeCapua et al. | 220/203.23 |
| 7,686,033 | B2 * | 3/2010 | Niki et al. | 137/543.23 |
| 7,823,610 | B2 * | 11/2010 | King | 141/303 |
| 2002/0148354 | A1 | 10/2002 | Amano et al. | |
| 2003/0034015 | A1 * | 2/2003 | Veinotte et al. | 123/519 |
| 2003/0037772 | A1 * | 2/2003 | Veinotte et al. | 123/518 |
| 2005/0188850 | A1 | 9/2005 | Allen et al. | |
| 2005/0217734 | A1 * | 10/2005 | Takakura | 137/587 |
| 2006/0185739 | A1 * | 8/2006 | Niki et al. | 137/543.23 |
| 2006/0196557 | A1 * | 9/2006 | Niki et al. | 137/543.23 |
| 2007/0051724 | A1 * | 3/2007 | DeCapua et al. | 220/203.28 |
| 2007/0107702 | A1 * | 5/2007 | King | 123/520 |
| 2007/0169842 | A1 * | 7/2007 | King | 141/302 |
| 2007/0251510 | A1 * | 11/2007 | Dunkle et al. | 123/520 |
| 2008/0041348 | A1 * | 2/2008 | Grant et al. | 123/519 |
| 2009/0025693 | A1 * | 1/2009 | Steinman et al. | 123/518 |
| 2009/0133672 | A1 * | 5/2009 | Crisan | 123/518 |
| 2011/0155107 | A1 | 6/2011 | Lin et al. | |
| 2012/0145006 | A1 | 6/2012 | Schroeder et al. | |

* cited by examiner

HYDROCARBON STORAGE CANISTER

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs the vapors. At a later time, when the engine is in operation, the evaporative emission control system allows the vapors to be purged into the engine intake manifold for use as fuel.

For example, U.S. Pat. No. 6,237,574 describes an evaporative emission canister that allows for adsorption of fuel vapors. The system includes more than one hydrocarbon adsorbing zone to buffer fuel vapor flowing through the canister.

The inventors herein have recognized various issues with the above system. In particular, adding hydrocarbon adsorbing zones increases the size of the evaporative emission canister. For example, in order to appropriately buffer fuel vapor, varying adsorbing zones are positioned in a cascading order, which contributes to increasing the length of an evaporative emission canister and thus the size of the canister shell. Increasing the size of the canister shell is superfluous for vehicles and/or fuel types that produce smaller hydrocarbon loads. Thus, evaporative emissions canisters are designed for each fuel delivery system, and necessitate different canister components to accommodate each vehicle. For example, the system of U.S. Pat. No. 6,237,574 would need a different sized canister shell to accommodate the varying number of adsorbing zones in order to accommodate different vehicle applications.

As such, one example approach to address the above issues is to provide a fuel vapor canister with a common canister shell capable of accommodating varying amounts of adsorptive material and/or providing various internal volumes. Further, the fuel vapor canister may include other common components including an end cap configured to couple with the common shell in different orientations. In this way, it is possible to accommodate different volumes of adsorptive material for different vehicle applications, and thus different hydrocarbon loads, while utilizing the same components across the different vehicle applications. In one embodiment, a shell of the fuel vapor canister may be coupled to an end cap in a first orientation to accommodate a first volume, or the end cap may be inverted and coupled to the same shell to accommodate a second, different volume. Further, by taking advantage of utilizing the same components, manufacturing costs may be reduced as the same fuel vapor canister components may be implemented for different vehicles even though the vehicles may have different fuel delivery systems.

Note that the fuel vapor canister may include other components such as a retention system including compression plates and/or springs which may be utilized to achieve other volumes of adsorptive material within the common shell. In this way, the fuel vapor canister may have increased versatility and as such may be applied to varying different vehicle applications. As such, manufacturing costs may be reduced and vehicle assembly may be simplified.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2A-3C are drawn approximately to scale.

DETAILED DESCRIPTION

The following description relates to an evaporative fuel vapor canister that includes an end cap, which may be oriented in different ways to accommodate different volumes of adsorptive material to be contained within a common shell of the fuel vapor canister. This arrangement allows for common vapor canister components to be utilized with different vehicles to achieve different evaporative emission control requirements. For example, due to the resulting geometric configuration of an end cap, this system may allow for either a more compact design or a more expanded design. Therefore the fuel vapor canister may be configured to adsorb either a relatively smaller or a relatively larger hydrocarbon load even though the individual components of the compact design and the expanded design have the same geometric dimensions. In this way, the individual components may associate with each other in different ways to achieve different adsorptive region volumes.

Figure 1:
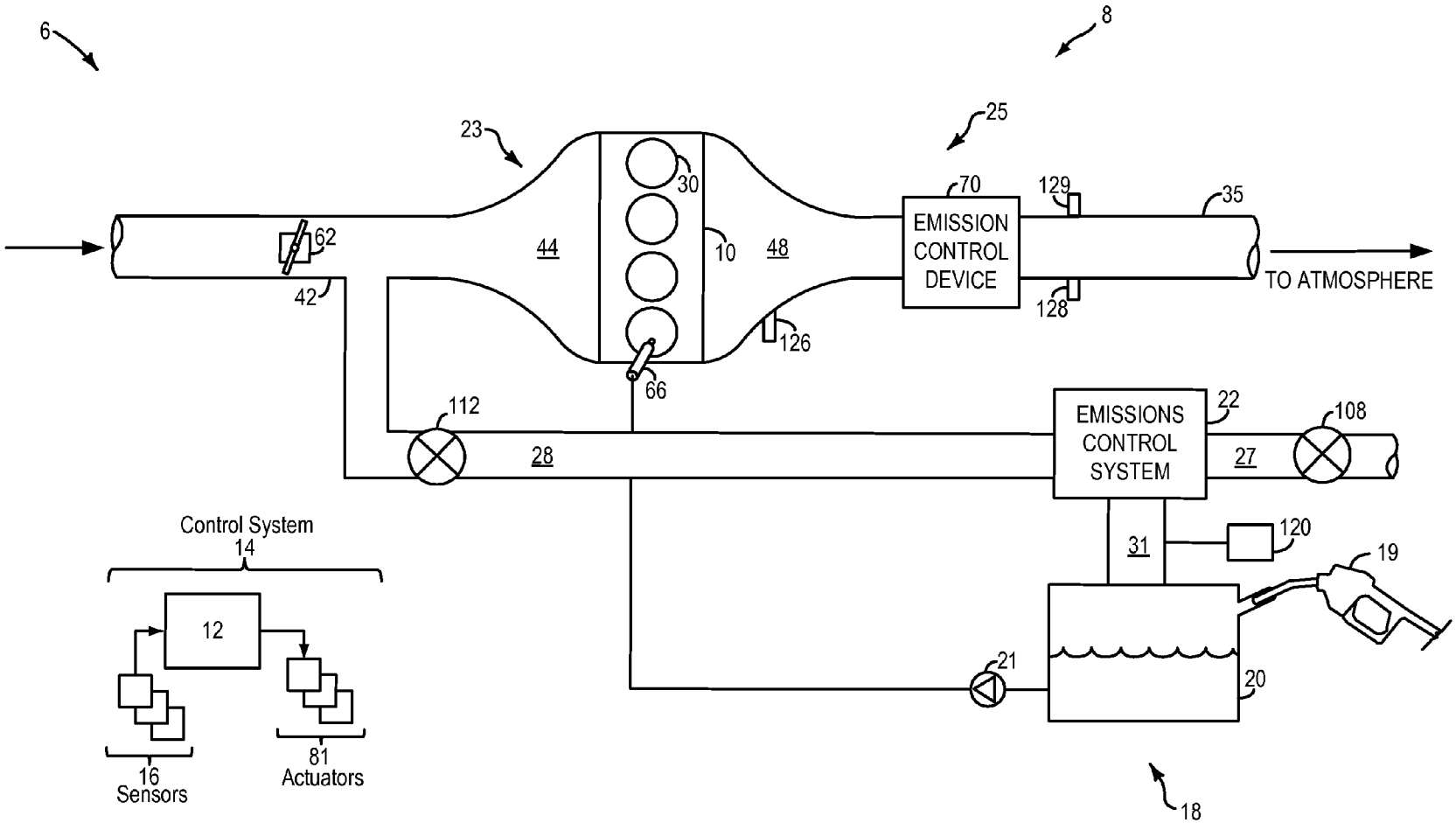
FIG. 1 shows a schematic depiction of an engine and an associated emissions control system.
Figure 2B:
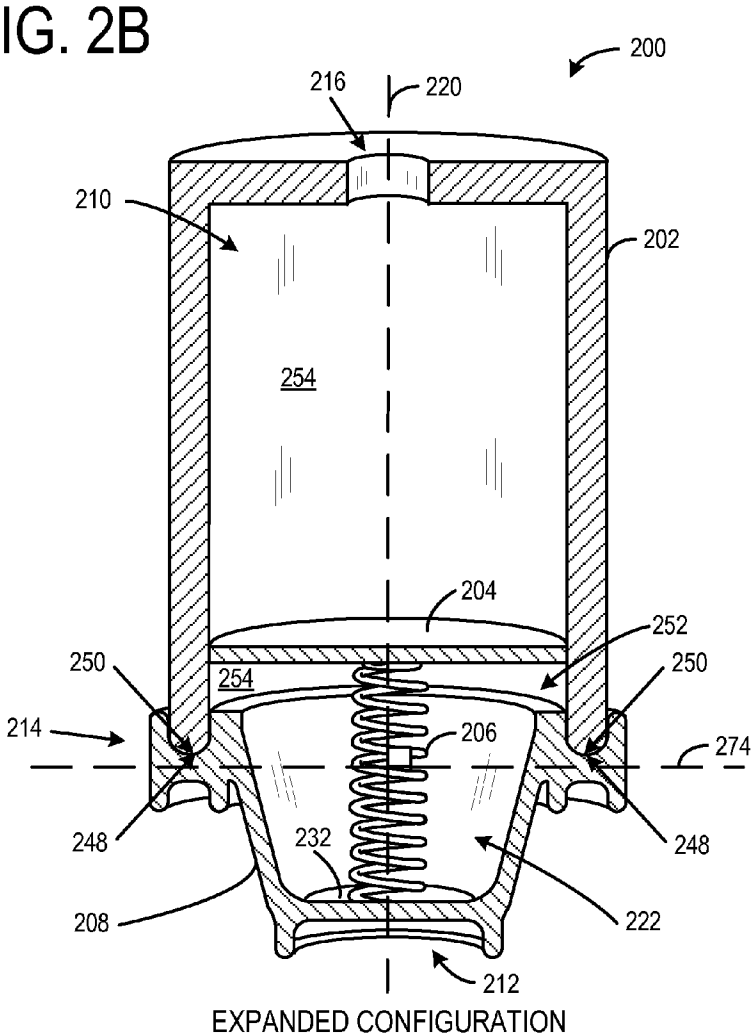
FIG. 2B shows a cross-sectional view of the example vapor canister of FIG. 2A in an expanded configuration according to an embodiment of the present disclosure.
Figure 2A:
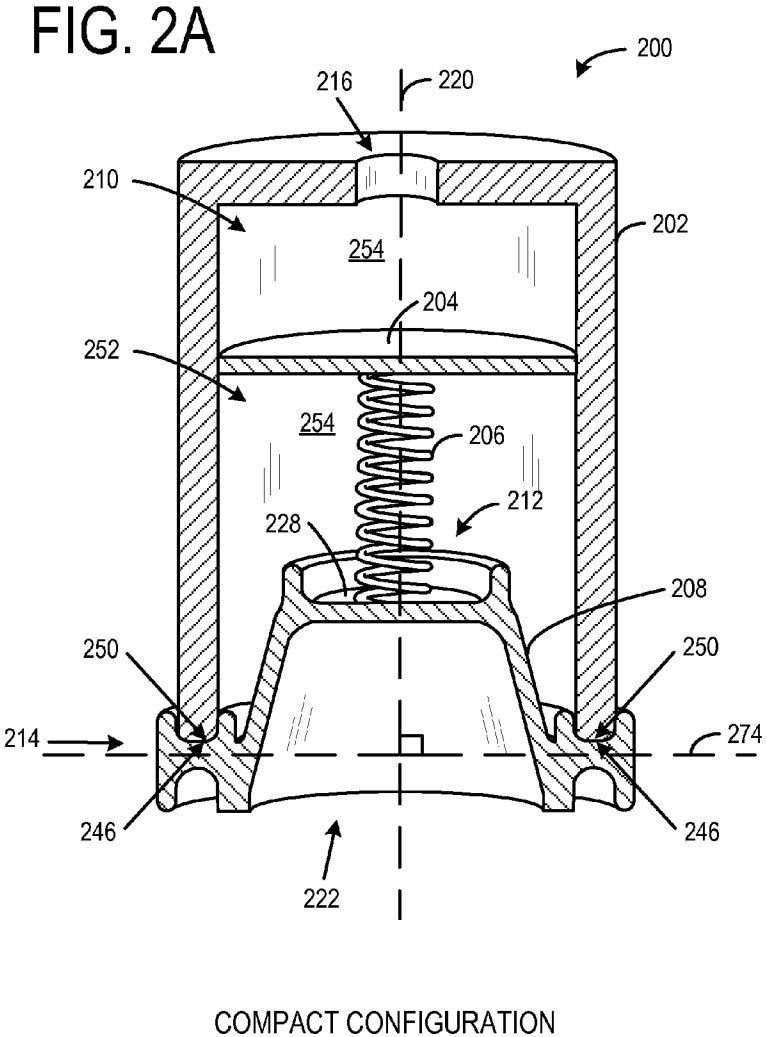
FIG. 2A shows a cross-sectional view of an example vapor canister in a compact configuration that may be included in the emissions control system of FIG. 1 according to an embodiment of the present disclosure.
Figure 3A:
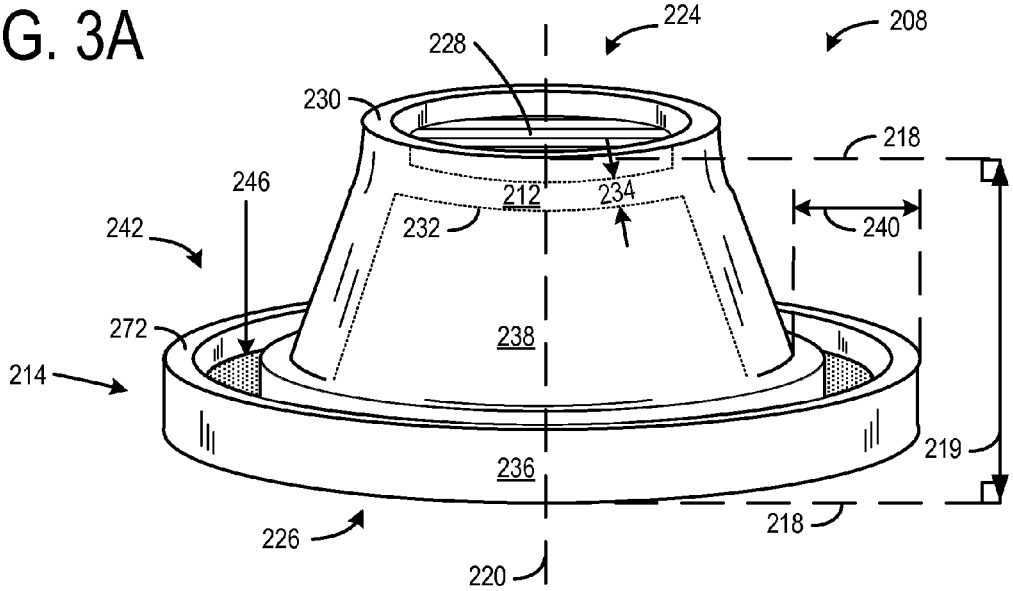
FIG. 3A shows a perspective view of an example end cap from the example vapor canister of FIG. 2A according to an embodiment of the present disclosure.
Figure 3B:
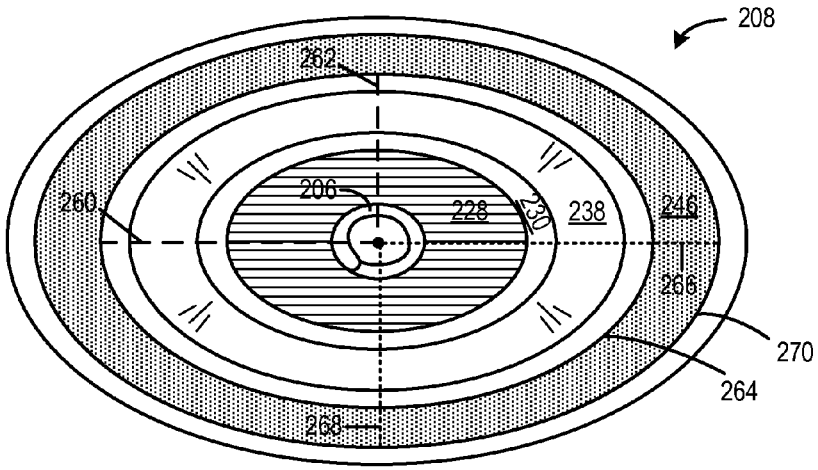
FIG. 3B schematically shows a top view of the example end cap of FIG. 3A.
Figure 3C:
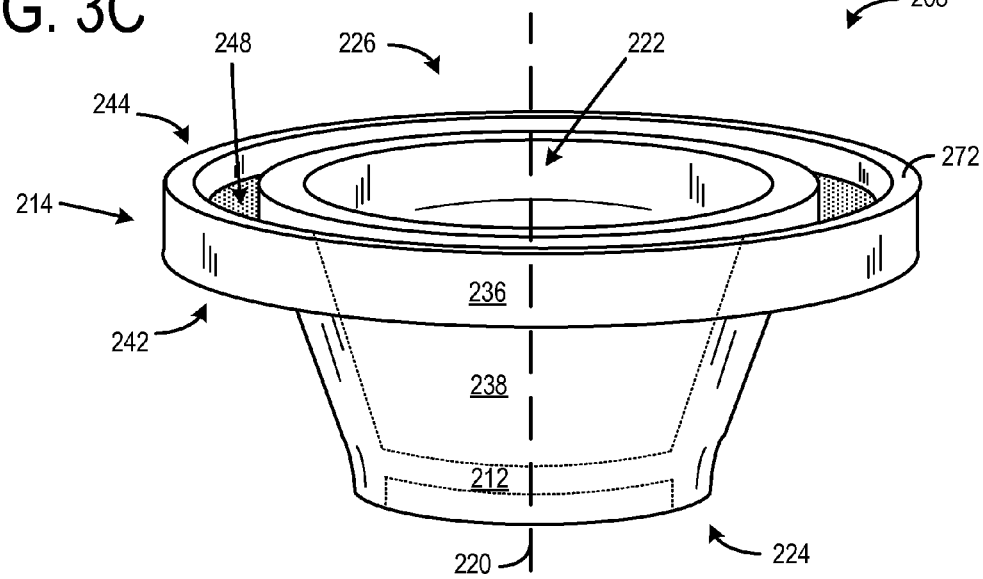
FIG. 3C shows another perspective view of the example end cap of FIG. 3A.
Figure 4:
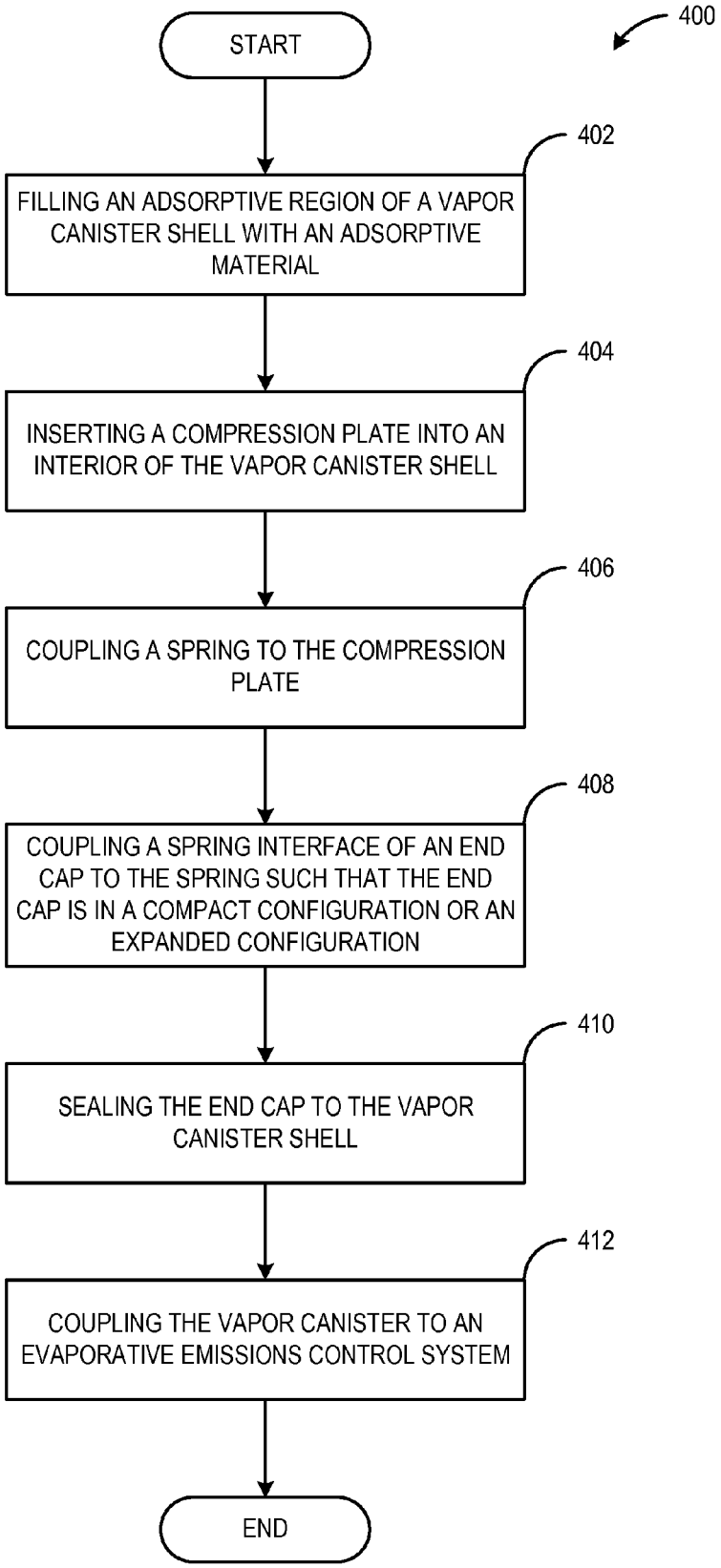
FIG. 4 illustrates an example method for installing the example vapor canisters of FIGS. 2A and 2B in a vehicle according to an embodiment of the present disclosure.
Figure 5:
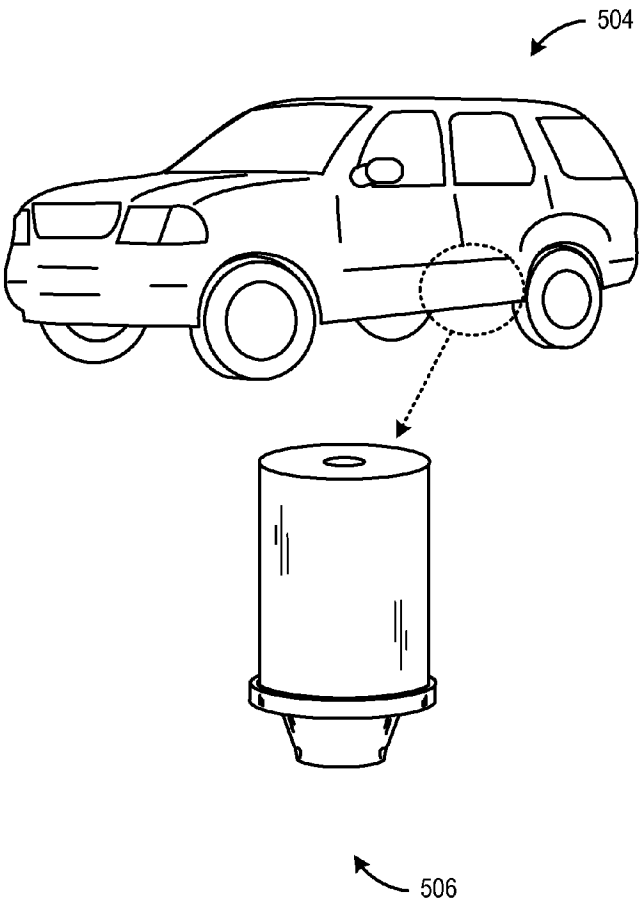
FIG. 5 shows example vehicles of a vehicle line utilizing the example vapor canisters of FIGS. 2A and 2B.
Figure 5:
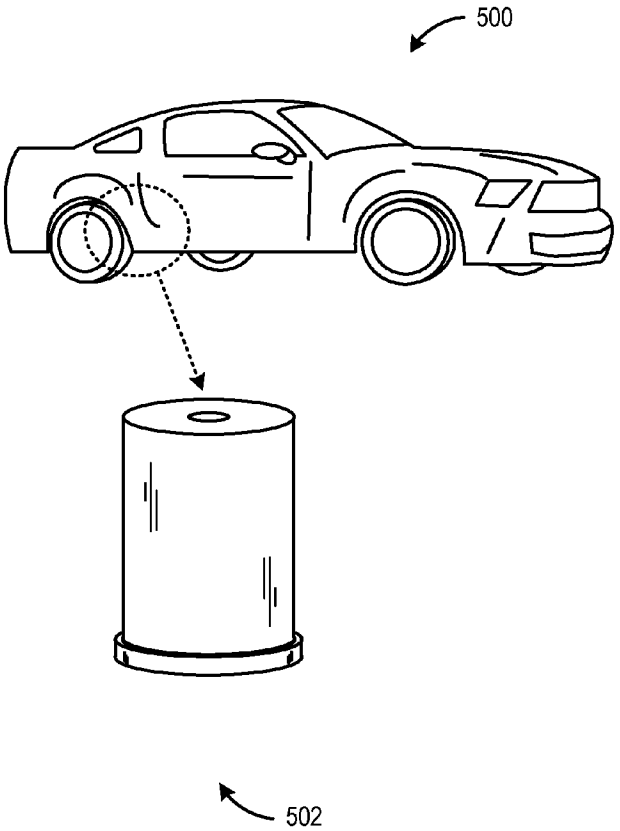

An example internal combustion engine including an associated emissions control system is depicted in FIG. 1. FIG. 2A shows an example vapor canister in a compact configuration that may be included in the emissions control system of FIG. 1. FIG. 2B shows the example vapor canister of FIG. 2A in an expanded configuration. FIGS. 3A-3C show various perspective views of an end cap that may be included in the example vapor canister of FIGS. 2A and 2B. FIG. 4 illustrates an example method for installing the example vapor canister of FIGS. 2A and 2B in a vehicle. FIG. 5 shows a plurality of vehicles from a vehicle line utilizing the example vapor canister in different configurations.

Referring specifically to FIG. 1, it shows a schematic depiction of a vehicle system 6. The vehicle system 6 includes an engine system 8 coupled to an emissions control system 22 and a fuel system 18. The engine system 8 may include an engine 10 having a plurality of cylinders 30. The engine 10 includes an engine intake 23 and an engine exhaust 25. The engine intake 23 includes a throttle 62 fluidly coupled to the engine intake manifold 44 via an intake passage 42. The engine exhaust 25 includes an exhaust manifold 48 leading to an exhaust passage 35 that routes exhaust gas to the atmosphere. The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 18 may include a fuel tank 20 coupled to a fuel pump system 21. As shown, fuel may be dispensed from a fuel station pump 19 to store within fuel tank 20 to provide fuel for fuel pump system 21. Fuel dispensed from pump 19 may enter fuel tank 20 via a fuel passage, as shown. The fuel pump system 21 may include one or more pumps for pressurizing fuel delivered to the injectors of engine 10, such as the example injector 66 shown. While only a single injector 66 is shown, additional injectors are provided for each cylinder. It will be appreciated that fuel system 18 may be a return-less fuel system, a return fuel system, or various other types of fuel system. Vapors generated in fuel system 18 may be routed to an emissions control system 22, described further below, via vapor recovery line 31, before being purged to the engine intake 23. Vapor recovery line 31 may optionally include a fuel tank isolation valve. Among other functions, fuel tank isolation valve may allow a fuel vapor canister of the emissions control system to be maintained at a low pressure or vacuum without increasing the fuel evaporation rate from the tank (which would otherwise occur if the fuel tank pressure were lowered). A fuel tank pressure transducer (FTPT) 120, or fuel tank pressure sensor, may be included between the fuel tank 20 and emissions control system 22, to provide an estimate of a fuel tank pressure, and for engine-off leak detection. The fuel tank pressure transducer may alternately be located in vapor recovery line 31, purge line 28, vent line 27, or emissions control system 22, without affecting its engine-off leak detection ability.

Emissions control system 22 may include one or more emissions control devices, such as one or more fuel vapor canisters filled with an appropriate adsorbent, the canisters configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 22 may further include a vent line 27 which may route gases out of the control system 22 to the atmosphere when storing, or trapping, fuel vapors from fuel system 18. Vent line 27 may also allow fresh air to be drawn into emissions control system 22 via an ambient air passage when purging stored fuel vapors from fuel system 18 to engine intake 23 via purge line 28 and purge valve 112. A canister check valve 116 may also be included in purge line 28 to prevent (boosted) intake manifold pressure from flowing gases into the purge line in the reverse direction. While this example shows vent line 27 communicating with fresh, unheated air, various modifications may also be used. Flow of air and vapors between emissions control system 22 and the atmosphere may be regulated by the operation of a canister vent solenoid (not shown), coupled to canister vent valve 108. A detailed system configuration of emissions control system 22 is described herein below with regard to FIGS. 2-5, including various additional components that may be included in the intake, exhaust, and fuel system.

The vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, and pressure sensor 129. Other sensors such as pressure, temperature, air/fuel ratio, and composition sensors may be coupled to various locations in the vehicle system 6, as discussed in more detail herein. As another example, the actuators may include fuel injector 66, valve 112, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 6A and 6B.

Emissions control system 22 operates to store vaporized hydrocarbons (HCs) from fuel system 18. Under some operating conditions, such as during refueling, fuel vapors present in the fuel tank may be displaced when liquid is added to the tank. The displaced air and/or fuel vapors may be routed from the fuel tank 20 to the emissions control system 22, and then to the atmosphere through vent line 27. In this way, an increased amount of vaporized HCs may be stored in emissions control system 22. During a later engine operation, the stored vapors may be released back into the incoming air charge using the intake manifold vacuum. Specifically, the emissions control system 22 may draw fresh air through vent line 27 and purge stored HCs into the engine intake for combustion in the engine. Such purging operation may occur during selected engine operating conditions as described herein.

FIGS. 2A-3 depict example components that may be included in emissions control system 22. It will be appreciated that like numbered components introduced in one schematic may be referenced similarly in other schematics and may not be reintroduced for reasons of brevity.

FIGS. 2A and 2B each show a cross-sectional view of an example vapor canister that may be included in emissions control system 22. FIG. 2A shows the example vapor canister in a compact configuration and FIG. 2B shows the example vapor canister in an expanded configuration. As shown, vapor canister 200 may include shell 202, compression plate 204, spring 206, and end cap 208.

It will be appreciated that shell 202, compression plate 204, spring 206, and end cap 208 may be common components. As used herein, common components may imply that the same components may be used for different vehicles and/or different fuel types. However, it will be appreciated that some components may be common between different vehicles while other components may not be common. As one example, different vehicles may share a common shell and a common end cap but may have a different spring and/or a different compression plate. As described in more detail below, a common shell and a common end cap may be configured to associate with each other in different ways to accommodate different volumes of adsorptive material. Further, one or more various springs and/or compression plates may be used in combination with the common shell and the common end cap in order to accommodate other volumes of adsorptive material.

As shown in FIGS. 2A and 2B, spring 206 may couple end cap 208 to compression plate 204 to apply pressure to absorptive material contained within an adsorptive region 210. Depending on the orientation of end cap 208, the size of the adsorptive region 210 may vary.

In particular, end cap 208 may include a double sided spring interface 212 and a double sided shell sealing surface 214 such that end cap 208 may be positioned in different orientations. As such, end cap 208 may associate with spring 206 via one of two different flat surfaces. As one example, spring 206 may be welded to one of the two different flat surfaces and the compression plate; however, it will be appreciated that spring 206 may retained between one of the two different flat surfaces and the compression plate in other ways. Further, end cap 208 may associate with shell 202 utilizing one of two different sealing surfaces. For example, the double sided shell sealing surface 214 may include double sided identical grooves appropriately sized to receive an end surface of shell 202. As described in more detail below, the geometric structure of end cap 208 may enable vapor canister 200 to contain varying amounts of adsorptive material while using the same components.

As shown in both FIGS. 2A and 2B, shell 202 may be generally cylindrical in shape. Shell 202 may include an opening 216 that may be configured to permit hydrocarbon emissions to enter adsorptive region 210. In this way, opening 216 may include a port in fluidic communication with a fuel delivery system of a vehicle. For example, opening 216 may include a load port in fluidic communication with a fuel delivery system. Further, it will be appreciated that shell 202 may include other openings to accommodate other ports. For example, shell 202 may include a purge port and a vent port to couple the fuel vapor canister to an engine and the atmosphere, respectively. Likewise, end cap 208 may additionally or alternatively include openings to facilitate the transmission of vapors and/or air between the fuel vapor canister and the engine and/or atmosphere.

Compression plate 204 and spring 206 may be configured to retain adsorptive material within adsorptive region 210. Therefore, compression plate 204 may have a shape that generally conforms to the interior region of shell 202. In this way, adsorptive material is retained within a portion of shell 202, whereas a remaining portion of shell 202 may not include adsorptive material. As described in more detail below, depending on the orientation of end cap 208, the fuel vapor canister may accommodate a relatively smaller volume of adsorptive material (compact configuration) or a relatively larger volume of adsorptive material (expanded configuration).

It will be appreciated that the fuel vapor canister provided in FIGS. 2A and 2B is provided as an example and is not meant to be limiting. As such, the fuel vapor canister may include additional or alternative components than those depicted. For example, the fuel vapor canister may include one or more filters to maintain carbon dust within the canister during vehicle operation. Further, fuel vapor canister may include a cover that may enclose shell 202 and end cap 208. As such, the cover may be configured to accommodate one or more load ports, purge ports, and vent ports. Further, it will be appreciated that the one or more ports may be located at other positions than opening 216 without departing from the scope of this disclosure. As another example, the fuel vapor canister may include more than one spring and/or more than one compression plate. In such cases, the fuel vapor canister may also include one or more features that divide the adsorptive region into one or more adsorptive zones. Further still, it will be appreciated that fuel vapor canister may include various tabs for J-clips, self-tap screw bosses, pins, etc. for attaching the fuel vapor canister to a vehicle.

FIGS. 3A-3C show various perspective views of end cap 208. As shown, end cap 208 may be shaped as a hollow conical frustum according to an embodiment of the present disclosure. FIG. 3A shows a perspective view of a closed end of end cap 208, FIG. 3B shows a top view of the closed end of end cap 208, and FIG. 3C shows a perspective view of an open end of end cap 208.

End cap 208 may have a geometric shape that generally resembles a conical frustum. In other words, end cap 208 may have a cone-like structure formed between two parallel planes 218, where each plane forms a base of the frustum. A height 219 of end cap 208 may be measured along a central axis 220, wherein the central axis 220 passes through a center of end cap 208 and is perpendicular to both planes 218.

Further, end cap 208 may be a hollowed out conical frustum, and as such, may include interior cavity 222. Therefore, end cap 208 may include a closed end 224 at one of the parallel planes and an open end 226 exposing interior cavity 222 that corresponds to the other parallel plane. As shown, closed end 224 may be located at a smaller circumference of end cap 208 than open end 226. In one example, closed end 224 may be located at a minimum circumference of the conical frustum. Said in another way, open end 226 may be located at a larger circumference of end cap 208 than closed end 224. In one example, open end 226 may be located at a maximum circumference of the conical frustum.

As best shown in FIG. 3B, end cap 208 may have a generally elliptical shaped outer surface. In this way, a cross sectional cut through the frustum at a plane orthogonal to the height of the frustum (e.g., a plane orthogonal to central axis 220) may reveal an ellipse shaped structure of end cap 208. Such a cross sectional cut of end cap 208 may have two axes of symmetry as is characteristic of an ellipse/oval, for example. However, it will be appreciated that end cap 208 may have a generally circular shaped outer surface (and likewise a circular cross section along a plane orthogonal to the central axis). In other words, it is within the scope of this disclosure that a cross sectional cut through end cap 208 may have one axis of symmetry. Further, it will be appreciated that end cap 208 may have another shape so long as the end cap is configured to receive an end surface of the common shell, thus enabling the end cap to be sealed to the shell.

Closed end 224 may include double sided spring interface 212. The double sided spring interface 212 may include two surfaces parallel to each other, where one surface is located on an exterior surface of end cap 208 and the other surface is located within interior cavity 222. In this way, double sided spring interface 212 may include two surfaces that oppose each other such that spring 206 may be coupled to only one of the surfaces. In this way, only one spring interface may be used to couple a spring and the other spring interface is not used to couple a spring.

For example, double sided spring interface 212 may include a first flat surface 228 positioned at closed end 224, such that first flat surface 228 coincides with an exterior surface of end cap 208. As shown best in FIG. 3A, first flat surface 228 may be a recessed portion of the exterior surface of end cap 208. In other words, first flat surface 228 may be a portion of the exterior surface spaced apart along central axis 220 from a top surface 230 of closed end 224. In this way, top surface 230 may form a ring around first flat surface 228, wherein as shown in FIG. 3A, top surface 230 may be elevated from first flat surface 228. However, it will be appreciated that when end cap 208 is oriented differently first flat surface 228 may be elevated along central axis 220 relative to top surface 230, for example, when end cap 208 is flipped such that top surface 230 functions as a bottom surface. In other words, top surface 230 and first flat surface 228 may be positioned on different planes that are parallel to each other and spaced apart by a distance coinciding with central axis 220. In some embodiments, first flat surface 228 may not be recessed. In other words, first flat surface 228 may be continuous with top surface 230.

A second flat surface 232 may be positioned at closed end 224 such that second flat surface 232 coincides with an interior surface of end cap 208. As such, second flat surface 232 may form a portion of the interior surface that defines interior cavity 222. In this way, first flat surface 228 and second flat surface 232 may be parallel to each other, and a space between the flat surfaces may define a thickness 234 of double sided spring interface 212. The thickness 234 of double sided spring interface 212 may be measured in a general direction along central axis 220, for example. As described in more detail below, a spring may be coupled to first flat surface 228 or second flat surface 232.

Open end 226 may include double sided shell sealing surface 214. As shown best in FIG. 3C, double sided shell sealing surface 214 may form a ring like structure positioned around a perimeter of the hollow conical frustum end cap 208. Therefore, double sided shell sealing surface 214 may be positioned at a greater circumference than double sided spring interface 212. Further, an outer surface 236 of double sided shell sealing surface 214 may have a greater circumference than a circumference of a portion of interior cavity 222 at open end 226. In other words, shell sealing surface 214 may be positioned proximate to open end 226 and extend in a circumferential direction from a main body 238 of end cap 208. As such, shell sealing surface 214 may have a width 240 that extends from main body 238 in a circumferential direction (e.g., a direction perpendicular to central axis 220).

As shown, shell sealing surface 214 may include double sided identical grooves, wherein one of the identical grooves is positioned with an upper region 242 and the other identical groove is positioned within a lower region 244. As best shown in FIG. 3A, upper region 242 may include a first identical groove 246. As best shown in FIG. 3C, lower region 244 may include a second identical groove 248. Each groove may be configured to receive an end surface 250 of shell 202 (as shown in FIGS. 2A and 2B).

As such, each groove may circumnavigate an outer perimeter of end cap 208, and each grove may have an identical groove depth, and groove width. Said in another way, the first and second identical grooves may have an identical inner eccentricity and an identical outer eccentricity if end cap 208 has an elliptical cross section through central axis 220. As shown best in FIG. 3B, first identical groove 246 may have a major radius 260 and a minor radius 262 associated with an inner groove boundary 264, and a major radius 266 and a minor radius 268 associated with an outer groove boundary 270. Likewise, since second identical groove 248 is identical in dimensions to first identical groove 246, second identical groove 248 would also be defined by the aforementioned radii and associated groove boundaries. If end cap 208 has a circular cross section, then the first and second identical grooves may have an identical inner radius and an identical outer radius.

Further, first and second identical grooves may have an identical groove depth. As shown best in FIGS. 3A and 3C, the double sided shell sealing surface 214 may include a rim surface 272 within upper region 242 and lower region 244. A groove depth may be measured from rim surface 272 to a groove surface along central axis 220. The distance from the upper region rim surface 272 to the groove surface of first identical groove 246 may be equal to the distance from the lower region rim surface 272 to the groove surface of second identical groove 248, as measured along central axis 220.

In this way, double sided shell sealing surface 214 includes double sided identical grooves to receive an end surface of a common shell. As such, the common shell may have inner and outer radii that are substantially identical to the inner and outer radii of the double sided identical grooves. Therefore, either groove may be used to seal common end cap 208 to common shell 202. As described in more detail below, depending on which groove is used as a sealing surface, shell 202 may be configured to contain a relatively smaller volume of adsorptive material or a relatively larger volume of adsorptive material.

Turning back to FIGS. 2A and 2B, first identical groove 246 and second identical groove 248 may correspond to different circumferences of the main body of end cap 208. For example, first identical groove 246 may be proximate to a smaller circumference of the main body of end cap 208 than second identical groove 248. Further, since first and second identical grooves are equal in dimensions as described above, first and second identical grooves are mirror images of each other about a plane 274 perpendicular to central axis 220. Therefore, first and second identical grooves have the same inner and outer radii, the same depth, and the same shape. It will be appreciated that end surface 250 of shell 202 is appropriately shaped so as to be closely received by either groove. Like two puzzle pieces fitting together, one of the identical grooves may be used to seal end cap 208 to shell 202. Depending on the orientation of end cap 208, end surface 250 may be sealed to either first identical groove 246 or second identical groove 248. Therefore, only one of the grooves may be utilized as a shell sealing surface and the other groove is not utilized as a shell sealing surface. As such, the groove which is not used as a shell sealing surface is not sealed to any component.

As shown in FIG. 2A, vapor canister 200 is in the compact configuration. As such, vapor canister 200 may be configured to contain a smaller volume of adsorptive material relative to the expanded configuration, which is described below. As one example, the compact configuration may enable vapor canister 200 to contain 0.5 liters of activated carbon. It will be appreciated that vapor canister 200 may accommodate pelletized activated carbon, granular activated carbon, or another adsorptive material.

As shown, the compact configuration may include end cap 208 oriented such that double sided spring interface 212 is projected into an interior region 252 of shell 202. In other words, a substantial portion of end cap 208 may be surrounded by interior walls 254 of shell 202. Therefore, double spring surface 212 may be positioned above end surface 250 in a direction along central axis 220 of the vapor canister. Said in another way, double sided spring interface 212 may be positioned between end surface 250 and compression plate 204. Such an orientation may allow first flat surface 228 to be utilized as a spring interface. Therefore, spring 206 may be coupled to first flat surface 228 and compression plate 204. Further, such an orientation may allow first identical groove 246 of double sided shell sealing surface 214 to be utilized as a shell sealing surface. Therefore, end surface 250 of shell 202 may be sealed to first identical groove 246.

In this way, first flat surface 228 and first identical groove 246 enable the compact configuration. Further, second flat surface 232 and second identical groove 248 are not coupled/sealed to any component. As shown, such a configuration may define an adsorptive region 210 within vapor canister 200. Therefore, adsorptive region 210 may be configured to hold a corresponding volume of adsorptive material such as activated carbon. In this way, end cap 208 and shell 202 associate with each other to form a first size vapor canister in the compact configuration. As indicated above, since end cap 208 and shell 202 are common components, and end cap 208 includes a double sided spring interface 212 and a double sided shell sealing surface 214, end cap 208 may be inverted to achieve a different sized vapor canister.

Turning to FIG. 2B, vapor canister 200 is shown in the expanded configuration. As such, vapor canister 200 may be configured to contain a larger volume of adsorptive material relative to the compact configuration. As one example, the expanded configuration may enable vapor canister 200 to contain 1.0 liters of activated carbon. As indicated above, it will be appreciated that vapor canister 200 may accommodate pelletized activated carbon, granular activated carbon, or another adsorptive material.

As shown, the expanded configuration may include end cap 208 oriented such that double sided spring interface 212 is projected away from interior region 252 of shell 202. In other words, a substantial portion of end cap 208 may be located outside of interior walls 254 of shell 202. Therefore, double spring surface 212 may be positioned below end surface 250 in a direction along the central axis 220 of the vapor canister. Said in another way, end surface 250 may be positioned between double sided spring interface 212 and compression plate 204. Such an orientation may allow second flat surface 232 to be utilized as a spring interface. Therefore, spring 206 may be coupled to second flat surface 232 and compression plate 204. Said in another way, a portion of spring 206 may be positioned with interior cavity 222 of end cap 208. Further, such an orientation may allow second identical groove 248 of double sided shell sealing surface 214 to be utilized as a shell sealing surface. Therefore, end surface 250 of shell 202 may be sealed to second identical groove 248.

In this way, second flat surface 232 and second identical groove 248 enable the expanded configuration. Further, first flat surface 228 and first identical groove 246 are not coupled/sealed to any component. As shown, such a configuration may define an adsorptive region 210 within vapor canister 200. Therefore, adsorptive region 210 may be configured to hold a corresponding volume of adsorptive material such as activated carbon. In this way, end cap 208 and shell 202 associate with each other to form a second size vapor canister in the expanded configuration, wherein the second sized vapor canister is capable of containing a greater volume of adsorptive material that the first sized vapor canister of FIG. 2A.

It will be appreciated that the geometric shape of end cap 208 and shell 202 as individual components is the same in both the expanded configuration and the compact configuration. However, depending on how end cap 208 associates with shell 202, the size of vapor canister 200 may change. As described above, the combination of the double sided spring interface 212 and the double sided shell sealing surface 214 enable end cap 208 to achieve different orientations and thus associate with a common shell in different configurations.

Thus, due to the geometric structure of end cap 208, vapor canister 200 may accommodate different volumes of adsorptive material while utilizing the same components, depending on the orientation of the end cap relative to the vapor canister. By coupling end cap 208 to vapor canister 200 in different orientations, the size of adsorptive region 210 may change to accommodate different vehicles, while utilize the same base components. In this way, a variety of different evaporative emission control requirements can be met by arranging end cap 208, shell 202, compression plate 204, and spring 206 differently.

FIG. 4 illustrates an example method 400 for installing the example vapor canisters of FIGS. 2A and 2B in a vehicle. Method 400 includes, at 402, filling an adsorptive region of a vapor canister shell with an appropriate volume of an adsorptive material. For example, vehicles that may produce a higher hydrocarbon load may include a vapor canister with a greater volume of adsorptive material than a vehicle that produces a smaller hydrocarbon load. For example, the adsorptive region may be able to accommodate 0.5 liters of activated carbon. As another example, the adsorptive region may be able to accommodate 1.0 liters of activated carbon.

At 404, method 400 includes inserting a compression plate into an interior of the vapor canister shell and positioning the compression plate such that it contacts the adsorptive material.

At 406, method 400 includes coupling a spring to the compression plate. For example, one end of a spring may be coupled to the compression plate by welding the spring to the compression plate. Further, one surface of the compression plate may contact the adsorptive material and the spring may be coupled to another surface that opposes the surface in contact with the adsorptive material of the compression plate, for example. In other words, the compression plate may be positioned between the adsorptive material and the spring.

At 408, method 400 includes coupling a spring interface of an end cap to the other end of the spring such that the end cap is in an appropriate orientation to accommodate the volume of adsorptive material within the adsorptive region of the vapor canister shell. For example, the end cap may be positioned in one of two orientations that enable either a compact configuration or an expanded configuration. As such, only one of the two spring interfaces is coupled to the spring and only one of the two shell sealing surfaces associates with an end surface of the vapor canister shell. In this way, the spring couples the end cap to the compression plate. For example, the spring may be welded to an exterior surface or an interior surface of an end cap. For example, a spring may be welded to either a first flat surface or a second flat surface of a double sided spring interface, as described above. Therefore, at least a portion of the spring and at least a portion of the end cap may also be positioned with the interior of the vapor canister shell.

At 410, method 400 includes sealing the end cap to the vapor canister shell to thereby form a seal around a perimeter of an end surface of the shell. Depending on the orientation of the end cap and thus the particular spring interface that the spring is coupled to, the end cap may be sealed to the shell via one of two shell sealing surfaces. For example, if the spring is coupled to the exterior surface of the end cap (e.g., first flat surface 228) then groove 246 of upper region 242 may be sealed to end surface 250 of shell 202. As such, the vapor canister may be configured to contain a compact volume of adsorptive material, as described above. If the spring is coupled to the interior surface of the end cap (e.g., second flat surface 232) then groove 248 of lower region 244 may be sealed to end surface 250 of shell 202. As such, the vapor canister may be configured to contain an expanded volume of adsorptive material, as described above.

At 412, method 400 includes coupling the vapor canister to an evaporative emissions control system. For example, the evaporative emissions control system may be in fluidic communication with a fuel delivery system. In this way, the vapor canister may adsorb hydrocarbons that may be present in fuel vapors during refueling of a vehicle, for example. As such, the fuel vapor canister may include one or more ports to couple the canister to a fuel passage, a vent line, a purge line, etc.

In this way, a vehicle line may include a plurality of vehicles where each vehicle may utilize the vapor canister in different ways. For example, a first vehicle may include a first size vapor canister coupled to a first fuel delivery system. In this example, the first size vapor canister may include a first shell, a first compression plate and a first end cap in a compact configuration, as described above.

Further, a second vehicle may include a second size vapor canister coupled to a second fuel delivery system. The second size vapor canister may include a second shell, a second compression plate and a second end cap in an expanded configuration, as described above. The second shell, the second compression plate, and the second end cap may have the same geometry as the first shell, the first compression plate, and the first end cap, respectively. Therefore different vehicles that may require different sized vapor canisters may utilize the same components (e.g., shell 202, compression plate 204, spring 206, and end cap 208) to achieve different volumes of adsorptive material.

For example, FIG. 5 shows a vehicle line of a plurality of different vehicle makes made and/or sold by a common manufacturer. The vehicle line includes a first vehicle 500 having a vapor canister in a compact configuration 502 and a second vehicle 504 having a vapor canister in an expanded configuration 506. As described above, first vehicle 500 may utilize a different sized vapor canister than second vehicle 504, yet the vapor canister of each vehicle may be comprised of the same components. In this way, the same components may be arranged in such a way so as to accommodate different volumes of adsorptive material with an adsorptive region of the canister shell. As shown, a smaller volume of adsorptive material contained within the vapor canister in the compact configuration 502 may be sufficient for adsorbing the hydrocarbon load associated with vehicle 500. Further, a comparatively larger volume of adsorptive material contained within the vapor canister in the expanded configuration 506 may be sufficient for adsorbing the hydrocarbon load associated with vehicle 504. In this way, a vehicle line may include a plurality of vehicles and may accommodate different hydrocarbon loads that may be emitted by the fuel system of each vehicle using the same vapor fuel canister components. Therefore, a vehicle assembly line may be simplified and manufacturing costs may be reduced.

Further, it will be appreciated that the compact configuration and the expanded configuration are provided as examples and other configurations to accommodate various other volumes of adsorptive material are possible without departing from the scope of this disclosure. As one example, springs with different spring constants may be utilized to achieve various other volumes of adsorptive material.

As described above, the particular geometry of end cap 208 enables vapor canister 200 to contain different volumes of adsorptive material depending on the orientation of end cap 208. Double sided spring interface 212 allows one of two opposing flat surfaces to be utilized to couple end cap 208 to compression plate 204 via spring 206. A corresponding shell sealing surface 214 may then be utilized to seal end cap 208 to shell 202, as described above.

Therefore, end cap 208 may provide greater versatility for a vapor canister such that the same parts may be utilized for different vehicles with different evaporative emissions control requirements. This provides the potential advantage of reducing manufacturing costs and simplifying emission control systems for a vehicle line comprising a plurality of vehicles.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel vapor canister comprising:

a shell;

a compression plate within the shell;

an end cap with a hollow conical frustum shape including a double sided spring interface and a double sided shell sealing surface having double sided identical grooves, only one of which sealed to the shell; and a spring coupled to the compression plate and only one interface.

2. The canister of claim 1, where the hollow conical frustum shape includes an open end exposing an interior cavity of the end cap, the open end located at a maximum circumference of the end cap.

3. The canister of claim 2, where the double sided shell sealing surface is a ring structure positioned around a perimeter of the end cap proximate to the open end.

4. The canister of claim 3, where one of the double sided identical grooves is included within an upper region of the double sided shell sealing surface and the other one of the double sided identical grooves is included within a lower region of the double sided shell sealing surface, the double sided identical grooves circumnavigating the end cap and corresponding to different circumferences of an end cap body, each identical groove having an inner and an outer radius identical to an inner and outer radius of the shell for receiving an end surface of the shell.

5. The canister of claim 2, where the double sided spring interface is located at a closed end of the end cap, the closed end located at a minimum circumference of the end cap.

6. The canister of claim 5, where a first flat surface of the double sided spring interface is located on an exterior of the end cap and a second flat surface of the double sided spring interface is located within the interior cavity of the end cap.

7. The canister of claim 6, where the spring is coupled to the first flat surface and the shell is coupled to the upper region resulting in a compact configuration or the spring is coupled to the second flat surface and the shell is coupled to the lower region resulting in an expanded configuration, where the compact configuration accommodates a smaller volume of adsorptive material than the expanded configuration.

8. The canister of claim 1, where the vapor canister is coupled to a fuel system of the engine to adsorb fuel vapors.

9. The canister of claim 8, further including a vent line and a vent valve to control ambient air passage into the vapor canister to purge vapors through a purge line to an intake manifold.

10. The canister of claim 9, further including a purge valve to regulate vapors entering the intake manifold.

11. A hydrocarbon storage canister comprising:

a shell;

a compression plate; and an end cap shaped as a hollow conical frustum including a shell sealing ring at a greater circumference of the end cap than a double sided spring interface that projects into an interior region of the shell, the shell sealing ring including an upper and a lower sealing surface wherein only the upper sealing surface is sealed to the shell.

12. The canister of claim 11, where the double sided spring interface is surrounded by interior walls of the shell.

13. The canister of claim 11, where the hollow conical frustum has an open end proximate to the shell sealing ring and a closed end corresponding with the double sided spring interface, and wherein the lower sealing surface of the shell sealing ring is not sealed to any component.

14. The canister of claim 13, where the double sided spring interface includes a first flat surface coupled to a spring such that the spring couples the end cap to the compression plate, and a second flat surface positioned within an interior cavity of the end cap and is not coupled to the spring, and wherein the upper and lower sealing surfaces are mirror images of each other about a plane perpendicular to a central axis of the shell.

15. The canister of claim 11, where the upper sealing surface is positioned on a plane corresponding to a smaller circumference of the end cap relative to the lower sealing surface.

16. The canister of claim 11, where the upper sealing surface is sealed to the shell such that the hydrocarbon storage canister has a smaller volume than if the lower sealing surface were sealed to the shell.

17. The canister of claim 16, where the smaller volume is approximately 0.5 liters.

18. A hydrocarbon storage canister comprising:

a shell;

a compression plate; and an end cap shaped as a hollow conical frustum including a shell sealing ring at a greater circumference of the end cap than a double sided spring interface that projects away from an interior region of the shell, the shell sealing ring including an upper and a lower sealing surface wherein only the lower sealing surface is sealed to the shell.

19. The canister of claim 18, where the double sided spring interface is outside from interior walls of the shell.

20. The canister of claim 18, where the hollow conical frustum has an open end proximate to the shell sealing ring and a closed end corresponding with the double sided spring interface, and wherein the upper sealing surface of the shell sealing ring is not sealed to any component.

21. The canister of claim 20, where the double sided spring interface includes a first flat surface positioned on an outer surface of the end cap exterior to a cavity of the end cap and is not coupled to a spring, and a second flat surface coupled to the spring such that the spring couples the end cap to the compression plate, and wherein the upper and lower sealing surfaces are mirror images of each other about a plane perpendicular to a central axis of the shell.

22. The canister of claim 18, where the lower sealing surface is positioned on a plane corresponding to a larger circumference of the end cap relative to the upper sealing surface.

23. The canister of claim 18, where the lower sealing surface is sealed to the shell such that the hydrocarbon storage canister has a larger volume than if the upper sealing surface were sealed to the shell.

24. The canister of claim 23, where the smaller volume is approximately 1.0 liters.

* * * * *